US009046276B2

(12) United States Patent
Kraft

(10) Patent No.: US 9,046,276 B2
(45) Date of Patent: Jun. 2, 2015

(54) SYSTEMS AND METHODS FOR CONTROLLING AN HVAC MOTOR

(75) Inventor: Wayne N. Kraft, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 451 days.

(21) Appl. No.: 13/549,051

(22) Filed: Jul. 13, 2012

(65) Prior Publication Data

US 2014/0014291 A1 Jan. 16, 2014

(51) Int. Cl.

| | |
|---|---|
| ***F24F 11/00*** | (2006.01) |
| ***F24F 11/04*** | (2006.01) |
| ***F24F 11/053*** | (2006.01) |
| ***F28F 27/00*** | (2006.01) |

(52) U.S. Cl.

CPC ..... *F24F 11/04* (2013.01); *F28F 27/00* (2013.01); *F24F 11/053* (2013.01); *F24F 11/0009* (2013.01); *F24F 11/0076* (2013.01); *F24F 2011/0057* (2013.01)

(58) Field of Classification Search

CPC . F24F 11/0009; F24F 11/0076; F24F 11/053; F24F 2011/0057; F28F 27/00

USPC ..... 700/28, 55, 83, 276; 165/11.1, 244, 165/247; 318/400.07, 400.08, 644

See application file for complete search history.

(56) References Cited

U.S. PATENT DOCUMENTS

| | | | | |
|---|---|---|---|---|
| 5,410,230 | A * | 4/1995 | Bessler et al. | 318/471 |
| 5,492,273 | A * | 2/1996 | Shah | 236/44 A |
| 5,709,533 | A | 1/1998 | Dias | |
| 5,736,823 | A * | 4/1998 | Nordby et al. | 318/432 |
| 5,926,386 | A | 7/1999 | Ott et al. | |
| 7,451,061 | B2 | 11/2008 | Saunders | |
| 7,562,536 | B2 | 7/2009 | Harrod et al. | |
| 8,672,733 | B2 * | 3/2014 | Chen et al. | 454/239 |
| 2007/0248467 | A1 * | 10/2007 | Shahi et al. | 417/1 |
| 2010/0298983 | A1 * | 11/2010 | Beste et al. | 700/276 |
| 2011/0066289 | A1 * | 3/2011 | Butler et al. | 700/276 |
| 2012/0253543 | A1 * | 10/2012 | Laughman et al. | 700/300 |
| 2013/0345995 | A1 * | 12/2013 | Shah et al. | 702/47 |
| 2014/0202188 | A1 * | 7/2014 | Hrejsa et al. | 62/228.1 |
| 2014/0323030 | A1 * | 10/2014 | Rugge et al. | 454/256 |

* cited by examiner

*Primary Examiner* — Robert Fennema
*Assistant Examiner* — Jennifer L Norton
(74) *Attorney, Agent, or Firm* — Conley Rose, P.C.; J. Robert Brown, Jr.; Michael J. Schofield

(57) ABSTRACT

A heating, ventilation, and/or air conditioning (HVAC) system has a motor configured to selectively provide an airflow, an airflow control algorithm configured receive an input and to provide a desired control value associated with a desired actual operation value of the motor, wherein the desired actual operation value is provided as a function of the input, and a control translator configured to receive the desired control value and to provide a correlated control value to the motor, wherein the correlated control value is associated with causing the motor to operate at the desired control value.

16 Claims, 5 Drawing Sheets

SYSTEMS AND METHODS FOR CONTROLLING AN HVAC MOTOR

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In some cases, a heating, ventilation, and/or air conditioning (HVAC) system fan motor may comprise both an electrical drive and a control package. The control package may accept performance commands, interpret those commands, and/or control the fan motor in response to the performance commands. In some cases, the control package may operate in a proprietary manner at least partially unknown to an HVAC system manufacturer. Accordingly, when an HVAC system manufacturer designs HVAC system controls that utilize a control package with less than fully understood operational characteristics, the design process may be time-consuming and/or labor-intensive. Further, the design process may result in the HVAC system controls being reliably operable with only the specific motor control around which the HVAC system controls were designed.

SUMMARY OF THE DISCLOSURE

In some embodiments, a heating, ventilation, and/or air conditioning (HVAC) system is disclosed as comprising a motor configured to selectively provide an airflow, an airflow control algorithm configured receive an input and to provide a desired control value associated with a desired actual operation value of the motor, wherein the desired actual operation value is provided as a function of the input, and a control translator configured to receive the desired control value and to provide a correlated control value to the motor, wherein the correlated control value is associated with causing the motor to operate at the desired control value.

In other embodiments, a method of operating a heating, ventilation, and/or air conditioning (HVAC) system is disclosed as comprising operating a control translator to receive a desired control value associated with a desired actual operation value of a motor of the HVAC system and operating the control translator to provide a correlated control value to the motor, wherein providing the correlated control value to the motor more effectively causes an actual operation value of the motor to achieve the desired actual operation value as compared to providing the desired control value to the motor.

In yet other embodiments, a method of controlling a motor of a heating, ventilation, and/or cooling (HVAC) system is disclosed as comprising providing an input to a universal airflow control algorithm that is configured to provide an output comprising a desired actual operation value of the motor, operating the universal airflow control algorithm to send a desired control value to a control translator comprising a control correlation table, the control correlation table comprising correlation data obtained as a result of testing the motor with a dynamometer, and operating the control translator to provide a correlated control value, the correlated control value being known as a relatively better input for providing to the motor as compared to the desired control value for the purpose of causing the motor to achieve the desired actual operation value.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

In some cases, HVAC systems may comprise control systems configured to control a motor in accordance with characteristics specific to the motor. In some cases, it may be desirous to replace the motor around which the control systems were designed with a different motor that may comprise different characteristics. Using the different motor without altering the control systems may result in poorly controlled operation of the HVAC system. Accordingly, this disclosure provides, in some embodiments, systems and methods for controlling an HVAC system in a manner more amenable to selectively utilizing motors having different characteristics. In some embodiments, a control system may be provided with a universally designed airflow control algorithm that may be used with any suitable motor that has been tested using a dynamometer.

Figure 1:
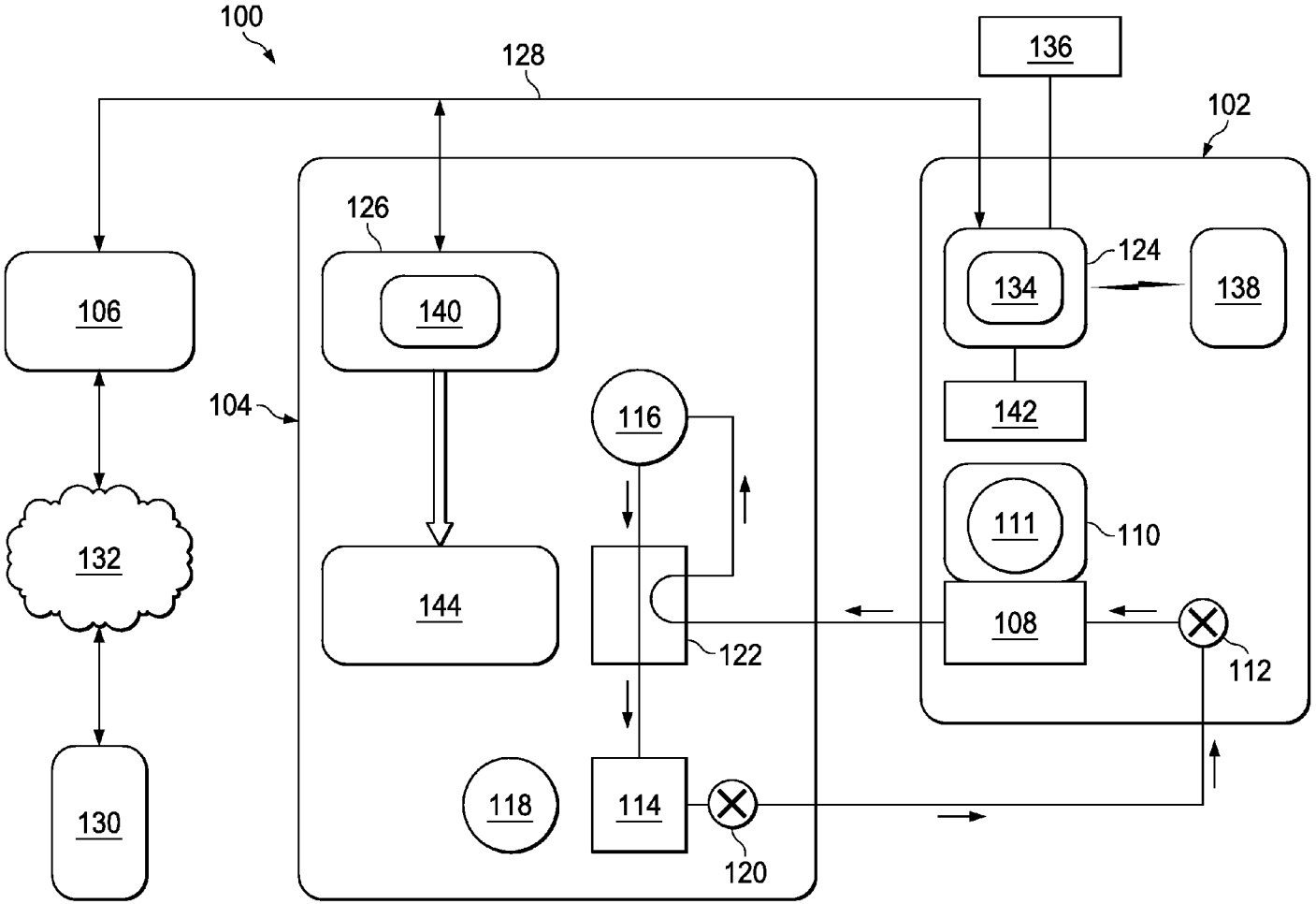
FIG. 1 is a schematic diagram of an HVAC system according to an embodiment of the disclosure.

Referring now to FIG. 1, a simplified schematic diagram of an HVAC system 100 according to an embodiment of this disclosure is shown. HVAC system 100 comprises an indoor unit 102, an outdoor unit 104, and a system controller 106. In some embodiments, the system controller 106 may operate to control operation of the indoor unit 102 and/or the outdoor unit 104. As shown, the HVAC system 100 is a so-called heat pump system that may be selectively operated to implement one or more substantially closed thermodynamic refrigeration cycles to provide a cooling functionality and/or a heating functionality.

Indoor unit 102 comprises an indoor heat exchanger 108, an indoor fan 110, and an indoor metering device 112. Indoor heat exchanger 108 is a plate fin heat exchanger configured to allow heat exchange between refrigerant carried within internal tubing of the indoor heat exchanger 108 and fluids that contact the indoor heat exchanger 108 but that are kept segregated from the refrigerant. In other embodiments, indoor heat exchanger 108 may comprise a spine fin heat exchanger, a microchannel heat exchanger, or any other suitable type of heat exchanger.

The indoor fan 110 is a centrifugal blower comprising a blower housing, a blower impeller at least partially disposed within the blower housing, and a blower motor 111 configured to selectively rotate the blower impeller. In other embodiments, the indoor fan 110 may comprise a mixed-flow fan and/or any other suitable type of fan. The indoor fan 110 is configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, the indoor fan 110 may be a single speed fan.

The indoor metering device 112 is an electronically controlled motor driven electronic expansion valve (EEV). In alternative embodiments, the indoor metering device 112 may comprise a thermostatic expansion valve, a capillary tube assembly, and/or any other suitable metering device. The indoor metering device 112 may comprise and/or be associated with a refrigerant check valve and/or refrigerant bypass for use when a direction of refrigerant flow through the indoor metering device 112 is such that the indoor metering device 112 is not intended to meter or otherwise substantially restrict flow of the refrigerant through the indoor metering device 112.

Outdoor unit 104 comprises an outdoor heat exchanger 114, a compressor 116, an outdoor fan 118, an outdoor metering device 120, and a reversing valve 122. Outdoor heat exchanger 114 is a spine fin heat exchanger configured to allow heat exchange between refrigerant carried within internal passages of the outdoor heat exchanger 114 and fluids that contact the outdoor heat exchanger 114 but that are kept segregated from the refrigerant. In other embodiments, outdoor heat exchanger 114 may comprise a plate fin heat exchanger, a microchannel heat exchanger, or any other suitable type of heat exchanger.

The compressor 116 is a multiple speed scroll type compressor configured to selectively pump refrigerant at a plurality of mass flow rates. In alternative embodiments, the compressor 116 may comprise a modulating compressor capable of operation over one or more speed ranges, the compressor 116 may comprise a reciprocating type compressor, the compressor 116 may be a single speed compressor, and/or the compressor 116 may comprise any other suitable refrigerant compressor and/or refrigerant pump.

The outdoor fan 118 is an axial fan comprising a fan blade assembly and fan motor configured to selectively rotate the fan blade assembly. In other embodiments, the outdoor fan 118 may comprise a mixed-flow fan, a centrifugal blower, and/or any other suitable type of fan and/or blower. The outdoor fan 118 is configured as a modulating and/or variable speed fan capable of being operated at many speeds over one or more ranges of speeds. In other embodiments, the outdoor fan 118 may be configured as a multiple speed fan capable of being operated at a plurality of operating speeds by selectively electrically powering different ones of multiple electromagnetic windings of a motor of the outdoor fan 118. In yet other embodiments, the outdoor fan 118 may be a single speed fan.

The outdoor metering device 120 is a thermostatic expansion valve. In alternative embodiments, the outdoor metering device 120 may comprise an electronically controlled motor driven EEV, a capillary tube assembly, and/or any other suitable metering device. The outdoor metering device 120 may comprise and/or be associated with a refrigerant check valve and/or refrigerant bypass for use when a direction of refrigerant flow through the outdoor metering device 120 is such that the outdoor metering device 120 is not intended to meter or otherwise substantially restrict flow of the refrigerant through the outdoor metering device 120.

The reversing valve 122 is a so-called four-way reversing valve. The reversing valve 122 may be selectively controlled to alter a flow path of refrigerant in the HVAC system 100 as described in greater detail below. The reversing valve 122 may comprise an electrical solenoid or other device configured to selectively move a component of the reversing valve 122 between operational positions.

The system controller 106 may comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, the system controller 106 may comprise a temperature sensor and may further be configured to control heating and/or cooling of zones associated with the HVAC system 100. In some embodiments, the system controller 106 may be configured as a thermostat for controlling supply of conditioned air to zones associated with the HVAC system.

In some embodiments, the system controller 106 may selectively communicate with an indoor controller 124 of the indoor unit 102, with an outdoor controller 126 of the outdoor unit 104, and/or with other components of the HVAC system 100. In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or other device 130 via a communication network 132. In some embodiments, the communication network 132 may comprise a telephone network and the other device 130 may comprise a telephone. In some embodiments, the communication network 132 may comprise the Internet and the other device 130 may comprise a so-called smartphone and/or other Internet enabled mobile telecommunication device.

The indoor controller 124 may be carried by the indoor unit 102 and may be configured to receive information inputs, transmit information outputs, and otherwise communicate with the system controller 106, the outdoor controller 126, and/or any other device via the communication bus 128 and/or any other suitable medium of communication. In some embodiments, the indoor controller 124 may be configured to communicate with an indoor personality module 134, receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

In some embodiments, the indoor EEV controller 138 may be configured to receive information regarding temperatures and pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112.

The outdoor controller 126 may be carried by the outdoor unit 104 and may be configured to receive information inputs, transmit information outputs, and otherwise communicate with the system controller 106, the indoor controller 124, and/or any other device via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the outdoor fan 118, a compressor sump heater, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with a compressor drive controller 144 that is configured to electrically power and/or control the compressor 116.

The HVAC system 100 is shown configured for operating in a so-called cooling mode in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant may primarily comprise liquid phase refrigerant and the refrigerant may be pumped from the outdoor heat exchanger 114 to the indoor metering device 112 through and/or around the outdoor metering device 120 which does not substantially impede flow of the refrigerant in the cooling mode. The indoor metering device 112 may meter passage of the refrigerant through the indoor metering device 112 so that the refrigerant downstream of the indoor metering device 112 is at a lower pressure than the refrigerant upstream of the indoor metering device 112. The pressure differential across the indoor metering device 112 allows the refrigerant downstream of the indoor metering device 112 to expand and/or at least partially convert to gaseous phase. The gaseous phase refrigerant may enter the indoor heat exchanger 108. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108. The refrigerant may thereafter reenter the compressor 116 after passing through the reversing valve 122.

To operate the HVAC system 100 in the so-called heating mode, the reversing valve 122 may be controlled to alter the flow path of the refrigerant, the indoor metering device 112 may be disabled and/or bypassed, and the outdoor metering device 120 may be enabled. In the heating mode, refrigerant may flow from the compressor 116 to the indoor heat exchanger 108 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may reenter the compressor 116 after passing through the reversing valve 122. Most generally, operation of the HVAC system 100 in the heating mode reverses the roles of the indoor heat exchanger 108 and the outdoor heat exchanger 114 as compared to their operation in the cooling mode.

Figure 2:
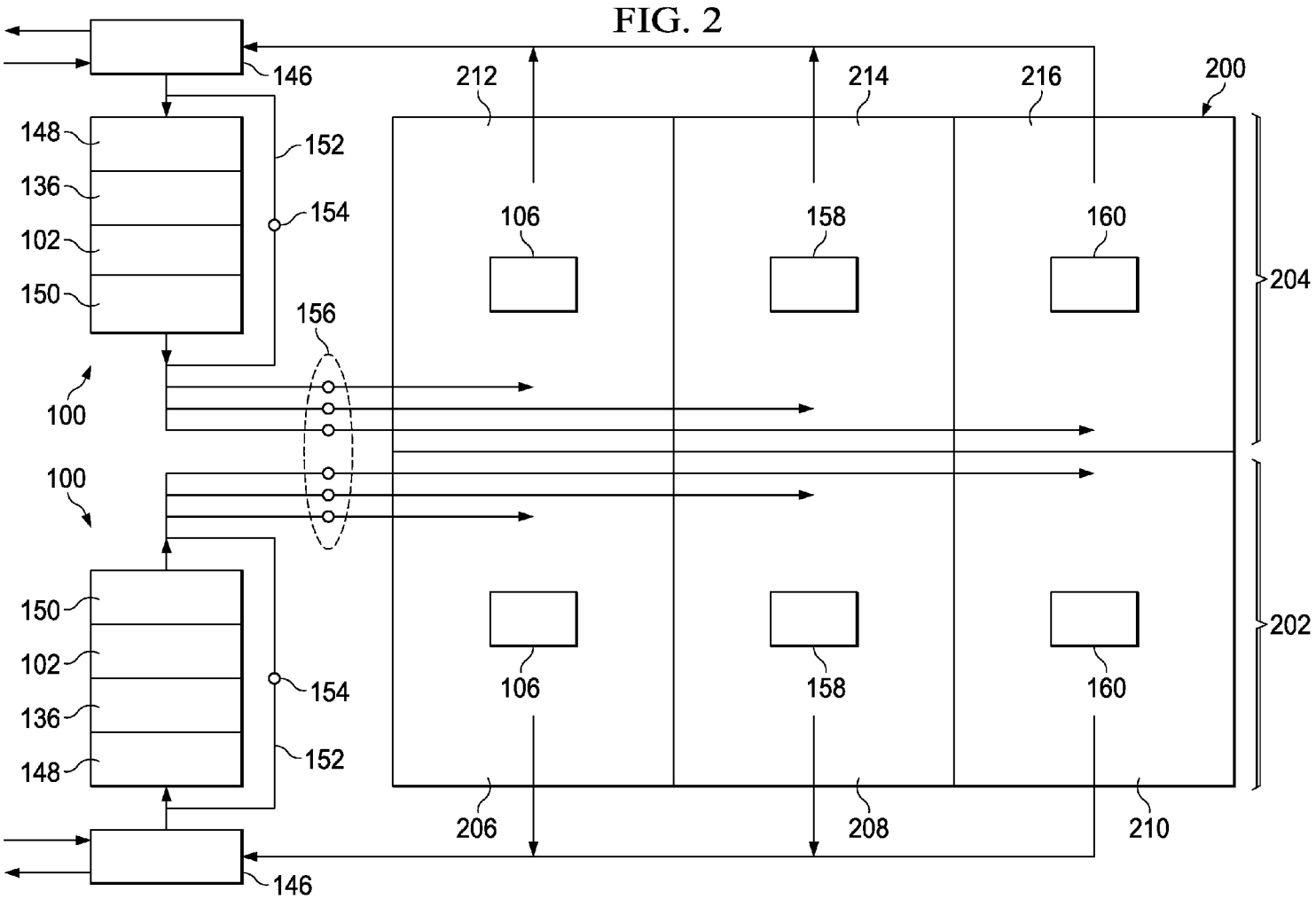
FIG. 2 is a schematic diagram of the air circulation paths of the HVAC system of FIG. 1.

Referring now to FIG. 2, a simplified schematic diagram of the air circulation paths for a structure 200 conditioned by two HVAC systems 100 is shown. In this embodiment, the structure 200 is conceptualized as comprising a lower floor 202 and an upper floor 204. The lower floor 202 comprises zones 206, 208, and 210 while the upper floor 204 comprises zones 212, 214, and 216. The HVAC system 100 associated with the lower floor 202 is configured to circulate and/or condition air of lower zones 206, 208, and 210 while the HVAC system 100 associated with the upper floor 204 is configured to circulate and/or condition air of upper zones 212, 214, and 216.

In addition to the components of HVAC system 100 described above, in this embodiment, each HVAC system 100 further comprises a ventilator 146, a prefilter 148, a humidifier 150, and a bypass duct 152. The ventilator 146 may be operated to selectively exhaust circulating air to the environment and/or introduce environmental air into the circulating air. The prefilter 148 may generally comprise a filter media selected to catch and/or retain relatively large particulate matter prior to air exiting the prefilter 148 and entering the air cleaner 136. The humidifier 150 may be operated to adjust a humidity of the circulating air. The bypass duct 152 may be utilized to regulate air pressures within the ducts that form the circulating air flow paths. In some embodiments, air flow through the bypass duct 152 may be regulated by a bypass damper 154 while air flow delivered to the zones 206, 208, 210, 212, 214, and 216 may be regulated by zone dampers 156.

Still further, each HVAC system 100 may further comprise a zone thermostat 158 and a zone sensor 160. In some embodiments, a zone thermostat 158 may communicate with the system controller 106 and may allow a user to control a temperature, humidity, and/or other environmental setting for the zone in which the zone thermostat 158 is located. Further, the zone thermostat 158 may communicate with the system controller 106 to provide temperature, humidity, and/or other environmental feedback regarding the zone in which the zone thermostat 158 is located. In some embodiments, a zone sensor 160 may communicate with the system controller 106 to provide temperature, humidity, and/or other environmental feedback regarding the zone in which the zone sensor 160 is located.

While HVAC systems 100 are shown as a so-called split system comprising an indoor unit 102 located separately from the outdoor unit 104, alternative embodiments of an HVAC system 100 may comprise a so-called package system in which one or more of the components of the indoor unit 102 and one or more of the components of the outdoor unit 104 are carried together in a common housing or package. The HVAC system 100 is shown as a so-called ducted system where the indoor unit 102 is located remote from the conditioned zones, thereby requiring air ducts to route the circulating air. However, in alternative embodiments, an HVAC system 100 may be configured as a non-ducted system in which the indoor unit 102 and/or multiple indoor units 102 associated with an outdoor unit 104 is located substantially in the space and/or zone to be conditioned by the respective indoor units 102, thereby not requiring air ducts to route the air conditioned by the indoor units 102.

Still referring to FIG. 2, the system controllers 106 may be configured for bidirectional communication with each other and may further be configured so that a user may, using any of the system controllers 106, monitor and/or control any of the HVAC system 100 components regardless of which zones the components may be associated. Further, each system controller 106, each zone thermostat 158, and each zone sensor 160 may comprise a humidity sensor. As such, it will be appreciated that structure 200 is equipped with a plurality of humidity sensors in a plurality of different locations. In some embodiments, a user may effectively select which of the plurality of humidity sensors is used to control operation of one or more of the HVAC systems 100.

Figure 3:
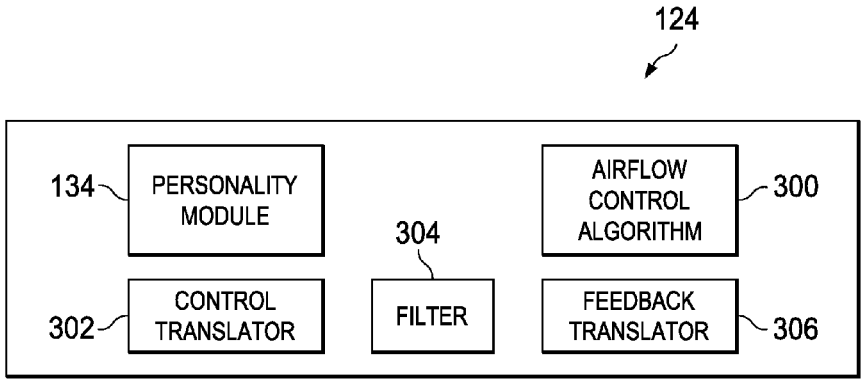
FIG. 3 is a schematic diagram of the system controller of the HVAC system of FIG. 1.
Figure 4:
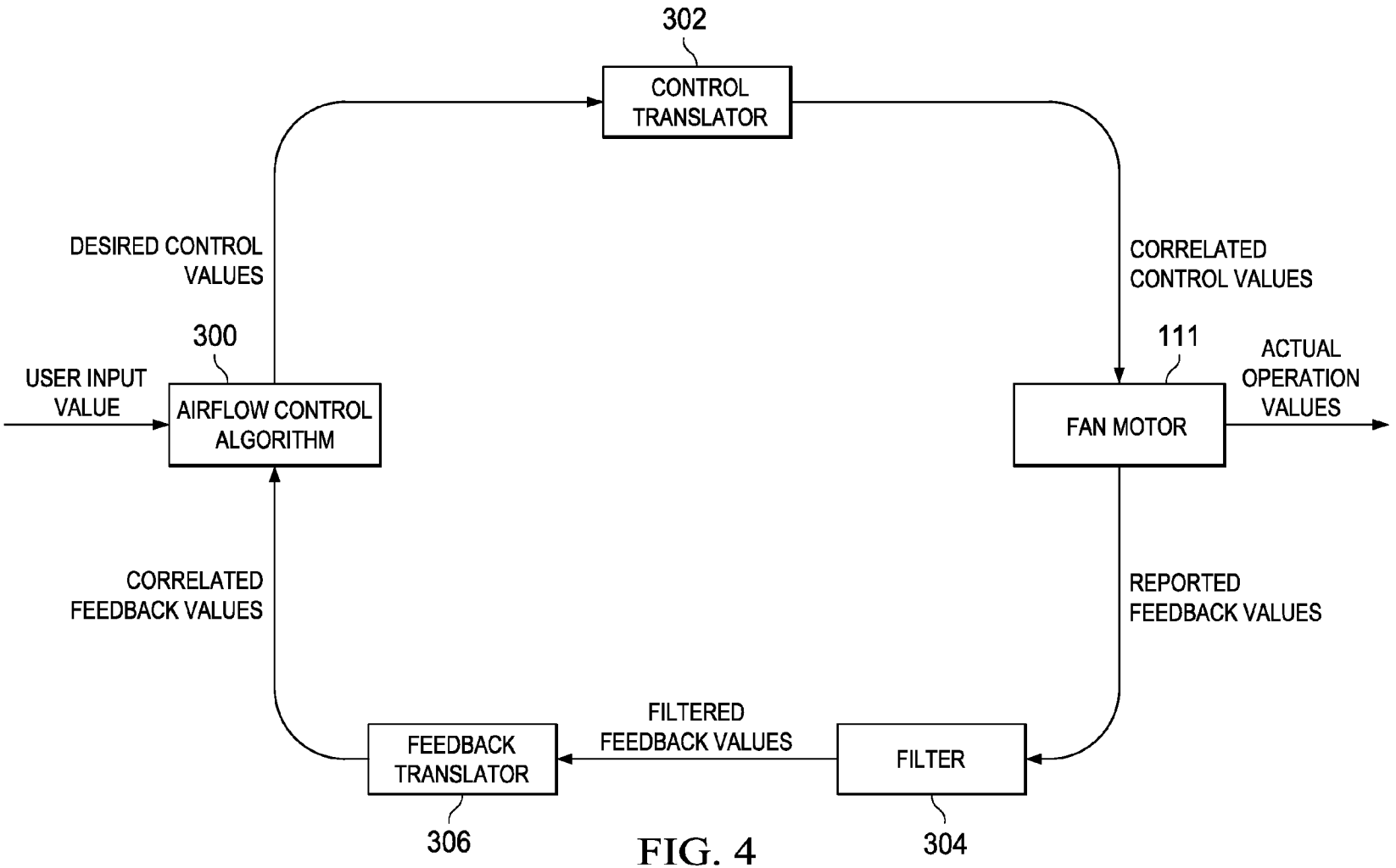
FIG. 4 is a schematic diagram of a portion of the HVAC system of FIG. 1.

Referring now to FIGS. 3 and 4, a schematic diagram of the indoor controller 124 and a schematic diagram of the indoor controller 124 with a fan motor 111 are shown, respectively. As mentioned above, the indoor controller 124 may be configured to communicate with an indoor personality module 134. In addition, the indoor controller 124 may further comprise an airflow control algorithm 300, a control translator 302, a filter 304, and a feedback translator 306.

The airflow control algorithm 300 may receive a user input value from the personality module 134, the zone thermostat 158, and/or another HVAC system 100 component. The input value may be a temperature, relative humidity, airflow rate, and/or other input that may affect control of a fan motor 111. The airflow control algorithm 300 may comprise a correlation table that matches the input value to desired control values that affect control of the fan motor 111. In some embodiments, the desired control value may comprise either a desired rotational speed for the fan motor 111 or a desired mechanical torque for the fan motor 111. The desired control values may be values determined by the airflow control algorithm 300 as being well suited for causing the fan motor 111 to operate in a manner that contributes to HVAC system 100 increasingly conforming to and/or maintaining conformance with the input values received by the airflow control algorithm 300.

The airflow control algorithm 300 correlation table may be derived from experimentally testing the HVAC system 100 in the field and/or a laboratory and/or through experimental simulations and/or modeling. In some embodiments, the desired control values may represent the operational conditions ultimately sought from the fan motor 111 by the airflow control algorithm 300. In other words, in some embodiments, the airflow control algorithm 300 may be configured to send a desired control value that directly represents an operational output demanded from the fan motor 111, such as a rotational speed or a mechanical torque, regardless of the brand, model, components, configuration, and/or any other feature of the fan motor 111 itself. The airflow control algorithm 300 may be referred to as being a so-called "universal" algorithm at least in part due to the algorithm's independence from any particular fan motor 111. Accordingly, the airflow control algorithm 300 may, in alternative embodiments, be utilized with a plurality of different fan motors 111 regardless of any differences in fan motor 111 control packages.

In some embodiments, providing the desired control values directly to the fan motor 111 may not result in the fan motor 111 being instructed to achieve the desired control values. For example, in some embodiments, the control package of the fan motor 111 may comprise proprietary components and/or functionality that may receive the desired control values and thereafter control the fan motor 111 to achieve values that are not the same as the desired control values. In other words, the control package of the fan motor 111 may misinterpret and/or undesirably change the desired control values in a manner that results in the fan motor 111 not achieving the desired control values.

In some embodiments, the fan motor 111 may comprise feedback components configured to measure, estimate, calculate, and/or otherwise provide reported feedback values associated with the actual operation values of the fan motor 111. For example, in some embodiments, the feedback components may be configured to ascertain an actual rotational speed of the fan motor 111 and an actual mechanical torque of the fan motor 111. However, in some embodiments, the reported feedback values provided by the feedback components of the fan motor 111 may not accurately represent the actual operation values of the fan motor 111. In other words, in some cases the fan motor 111 may be operating at actual operation values while the feedback components of the fan motor 111 may provide reported feedback values that improperly indicate that the fan motor 111 is operating at values other than the actual operation values.

The above described impediments to accurately commanding the fan motor 111 according to desired control values and accurately reporting actual operation values may be alleviated by using information about the components and/or operational characteristics specific to the fan motor 111. In some cases, a fan motor 111 may be experimentally investigated using a dynamometer and other related data gathering components and/or techniques. More specifically, a dynamometer may be used to discover a variety of relationships between both the commands sent to a fan motor 111 and the feedback received from the fan motor relative to the actual performance of the fan motor 111. For example, dynamometer testing may comprise sending desired control values to the fan motor 111 and recording both the resultant actual operation values and the reported feedback values. More specifically, desired control values may be sent in the form of desired control rotational speed values or desired control mechanical torque values and the resultant actual rotational speeds, actual mechanical torques, reported feedback rotational speed values, and/or reported feedback mechanical torque values may be recorded.

In some embodiments, the above-described experimental findings may be utilized to generate so-called correlation tables and/or so-called lookup tables comprising the actual operation values correlated with (1) the control values received by the tested fan motor 111 to achieve the actual operation values and (2) the reported feedback values reported by the fan motor 111 while operating at the actual operation values. For example, a control correlation table may associate a plurality of correlated control values with associated actual operation values so that the control correlation table may serve as a reference in determining what correlated control value may be provided to a fan motor 111 to result in a selected actual operation value. Similarly, a feedback correlation table may associate a plurality of correlated feedback values with associated actual operation values so that the feedback correlation table may serve as a reference in determining the actual operation values of the fan motor 111 for selected reported feedback values. Of course, in alternative embodiments, the information gathered as a result of dynamometer and/or other testing of a fan motor 111 may be utilized to generate any other suitable type of association between the actual performance of a fan motor 111 and both the commands used to cause the actual performance and the feedback received in response to the actual performance. In some embodiments, data correlating a set of correlated control values to a set of actual operation values may be utilized. The data may comprise data associated with an equation and/or empirical fit suitable for associating the set of correlated control values to the set of actual operation values. In alternative embodiments, equations and/or empirical fit data may be utilized to correlate any other suitable sets of data.

The control translator 302 may comprise a control correlation table. The control translator 302 may be configured to receive the desired control values from the airflow control algorithm 300. In some embodiments, the control translator 302 may utilize the above-described control correlation table to determine which correlated control value is associated with the desired actual operation value provided by the desired control values. The translator 302 may be further configured to send the correlated control values associated with the desired actual operation values provided by the desired control values to the fan motor 111. Upon receiving the correlated control values, the fan motor 111 may attempt to operate in accordance with the correlated control values in an effort to provide the desired actual operation values. In some cases, variations in the environment surrounding the HVAC system 100 may prevent the actual operation values of the fan motor 111 to equal the desired actual operation values even though the fan motor 111 is operating in response to the correlated control values.

As part of a feedback control feature of the HVAC system 100, the feedback components of the fan motor 111 may provide reported feedback values for use in adjusting control of the fan motor 111 to more accurately operate according to the correlated control values in spite of the environmental and/or other impediments to operational compliance of the fan motor 111. However, the feedback components of the fan motor 111 may not be configured to accurately report the actual operation values of the fan motor 111. In some cases, the reported feedback values may be inaccurate as a result of inadequate feedback component quality and/or design. Nonetheless, the feedback components of the fan motor 111 may be configured to send the reported feedback values to the filter 304.

The filter 304 may receive the reported feedback values, filter those reported feedback values, and generate and/or pass through filtered feedback values. The filter 304 may adjust the reported feedback values to the same time scale as the airflow control algorithm 300, account for aberrant values, and/or smooth out the reported feedback values into a less noisy curve and/or signal. The filter 304 may comprise a low-pass, an average, a spline, and/or any other suitable filter type. For example, if the filter 304 is a low-pass filter and/or high cut filter, the filter may remove and/or attenuate signals and/or values indicating that the fan motor 111 rotational speed and/or mechanical torque is greater than a known physical limit of the fan motor 111. The filter 304 may be configured to send filtered feedback values to the feedback translator 306.

The feedback translator 306 may comprise a feedback correlation table. The feedback translator 306 may receive the filtered feedback values from the filter 304. In some embodiments, the feedback translator 302 may utilize the above-described feedback correlation table to determine which correlated feedback values are associated with the received reported feedback values. The feedback translator 306 may be further configured to send the correlated feedback values that may be representative of the actual operation values of the fan motor 111 to the airflow control algorithm 300. After receiving the correlated feedback values, the airflow control algorithm 300 may compare the correlated feedback values to the desired control values and attempt to correct any errors by adjusting the desired control values and sending new desired control values.

Figure 5:
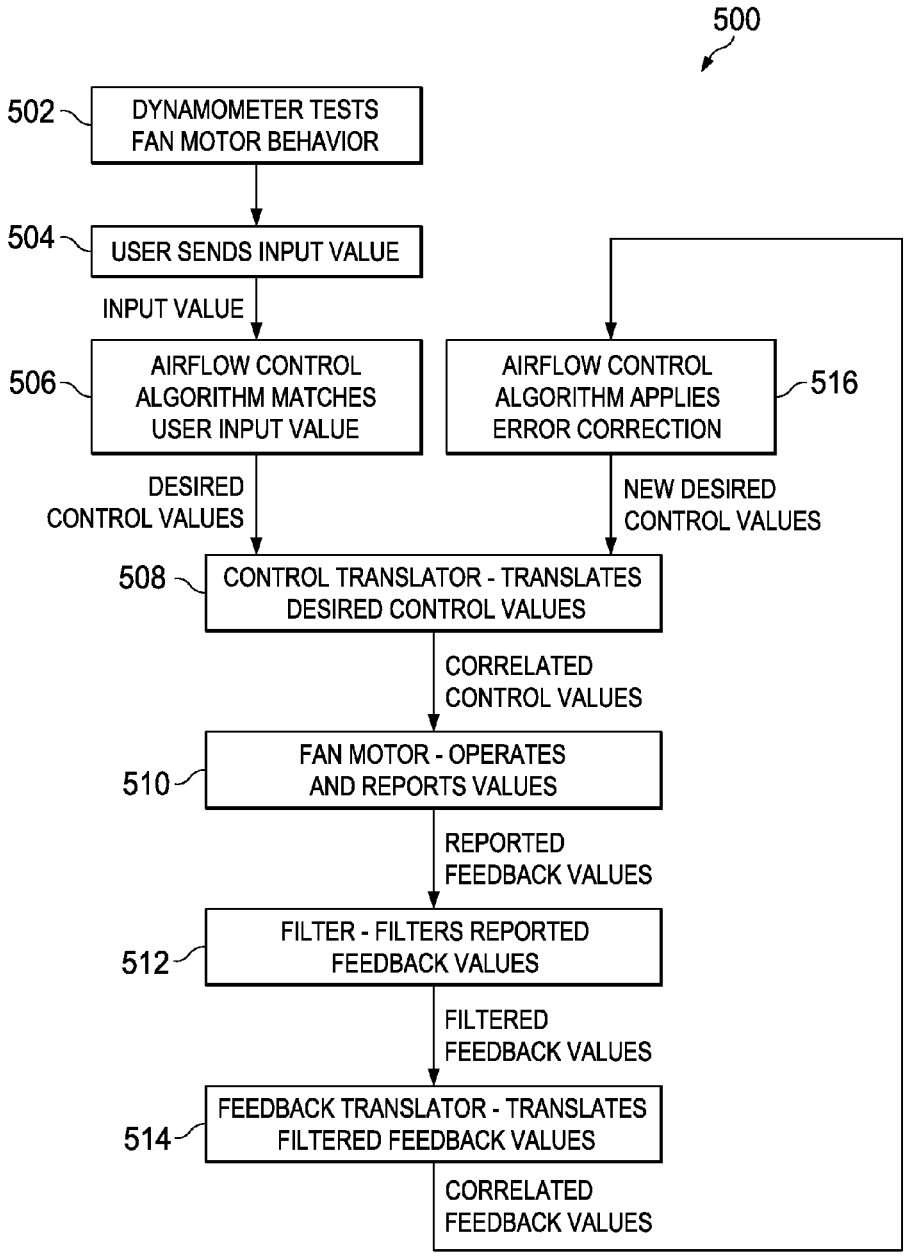
FIG. 5 is a flowchart of a method of operating an HVAC system according to an embodiment of the disclosure.

Referring now to FIG. 5, a flowchart of a method 500 of operating an HVAC system 100 according to an embodiment is shown. The method 500 may begin at block 502 where a dynamometer may be utilized to test a fan motor 111. Based on the dynamometer testing, the HVAC vendor may model the fan motor 111 behavior by generating correlation tables, algorithms, and/or other means of representing relationships between desired control values sent to the fan motor 111, reported feedback values provided by the fan motor, and actual operation values of the fan motor 111. Tables 1 and 2 are examples of control correlation tables that correlate desired control values with correlated control values. In practice, actual correlation tables may look similar to Tables 1 and 2, though they may comprise a greater amount of data to enable correlation over a greater range and/or greater resolution of values. In some embodiments, torque and/or speed values may be represented as percentage values, such as, but not limited to, percentages of a maximum rated speed, a maximum rated torque, a maximum allowed speed, and/or a maximum allowed torque.

TABLE 1

| Desired Control Values (rotational speed in RPM) | Correlated Control Values (rotational speed in RPM) |
|---|---|
| 1,050 | 950 |
| 1,025 | 925 |
| 1,000 | 900 |
| 975 | 875 |
| 950 | 850 |

TABLE 2

| Desired Control Values (mechanical torque in N-m) | Correlated Control Values (mechanical torque in N-m) |
|---|---|
| 1.10 | 1.00 |
| 1.05 | 0.95 |
| 1.00 | 0.90 |
| 0.95 | 0.85 |
| 0.90 | 0.80 |

Tables 3 and 4 are examples of feedback correlation tables that correlate reported feedback values with correlated feedback values. In practice, actual correlation tables may look similar to Tables 3 and 4, though they may comprise a greater amount of data to enable correlation over a greater range of values. After testing the fan motor 111, the method 500 may progress to block 504.

TABLE 3

| Reported Feedback Values (rotational speed in RPM) | Correlated Feedback Values (rotational speed in RPM) |
|---|---|
| 1,000 | 1,040 |
| 975 | 1,015 |
| 950 | 990 |
| 925 | 965 |
| 900 | 940 |

TABLE 4

| Reported Feedback Values (mechanical torque in N-m) | Correlated Feedback Values (mechanical torque in N-m) |
|---|---|
| 1.05 | 1.09 |
| 1.00 | 1.04 |
| 0.95 | 0.99 |
| 0.90 | 0.94 |
| 0.85 | 0.89 |

At block 504, the user may send an input value to the airflow control algorithm 300. For example, the input value may comprise a desired temperature of 70° F. that may be delivered to the airflow control algorithm 300 by a thermostat such as a system controller 106. More specifically, in some embodiments, a thermostat such as a system controller 106 may determine the HVAC system 100 should begin delivering conditioned air and the thermostat may send an input value in the form of an airflow target to the indoor controller 124. In alternative embodiments, a thermostat such as a system controller 106 may communicate a simple on/off type input value to the indoor controller 124 to initiate delivery of conditioned air. After receiving the input value, the method 500 may progress to block 506.

At block 506, the airflow control algorithm 300 may match or otherwise determine that to achieve the requested input value of 70° F., the fan motor should be controlled to operate according to a desired control value, either 1,000 RPM or 1.00 N-m, a desired rotational speed or a desired mechanical torque, respectively. Table 5 is an example of outputs that the airflow control algorithm 300 may provide in response to receiving various input values while the HVAC system is in a cooling mode. The airflow control algorithm 300 may send the desired control value to the control translator 302. In some embodiments, the airflow control algorithm 300 may interpret the input value and output a desired control value. After sending the desired control value to the control translator 302, the method 500 may progress to block 508.

TABLE 5

| Desired Temperature (°) | Desired Rotational Speed (RPM) | Desired Mechanical Torque (N-m) |
|---|---|---|
| 60 | 1,050 | 1.10 |
| 65 | 1,025 | 1.05 |
| 70 | 1,000 | 1.00 |
| 75 | 975 | 0.95 |
| 80 | 950 | 0.90 |

At block 508, the control translator 302 may receive the desired control value, translate the desired control value using Tables 1 and 2 to determine a correlated control value, and send correlated control value to the fan motor 111. For example, the control translator 302 may receive a desired control value of either 1000 RPM or 1 N-m and send a correlated control value of either 900 RPM or 0.90 N-m to the fan motor 111. In other words, according to the correlated data of the control translator 302, in order to cause the fan motor 111 to attempt to perform at either 1,000 RPM or 1.00 N-m, the HVAC system 100 may need to instruct the fan motor 111 to perform at either 900 RPM or 0.90 N-m. After the fan motor 111 has received the correlated control value, the method 500 may progress to block 510.

At block 510, the fan motor 111 may operate in response to the received correlated control value and generate reported feedback values. Continuing with the example above, after sending to the fan motor 111 a correlated control value of either 900 RPM or 0.90 N-m, the fan motor 111 may actually operate at 980 RPM and 0.98 N-m while also providing inaccurate reported feedback values of 950 RPM and 0.95 N-m. The fan motor 111 may send the reported feedback values to a filter 304. Tables 6 and 7 show the correlation between the correlated control values sent to the fan motor 111 and the resultant actual operation values and reported feedback values. After sending the reported feedback values to the filter 304, the method 500 may progress to block 512.

TABLE 6

| Correlated Control Values (rotational speed in RPM) | Reported Feedback Values (rotational speed in RPM) | Actual operation values (rotational speed in RPM) |
|---|---|---|
| 950 | 1,000 | 1,030 |
| 925 | 975 | 1,005 |
| 900 | 950 | 980 |
| 875 | 925 | 955 |
| 850 | 900 | 930 |

TABLE 7

| Correlated Control Values (mechanical torque in N-m) | Reported Feedback Values (mechanical torque in N-m) | Actual operation values (mechanical torque in N-m) |
|---|---|---|
| 1.00 | 1.05 | 1.08 |
| 0.95 | 1.00 | 1.03 |
| 0.90 | 0.95 | 0.98 |
| 0.85 | 0.90 | 0.93 |
| 0.80 | 0.85 | 0.88 |

At block 512, the filter 304 may filter the reported feedback values of 950 RPM and 0.95 N-m and provide filtered feedback values. In some embodiments where the filter 304 does not alter any of the reported feedback values, the filtered feedback values may be identical to the reported feedback values. Accordingly, in some embodiments, the filter 304 may send filtered feedback values of 950 RPM and 0.95 N-m to the feedback translator 306. After sending the filtered feedback values, the method 500 may progress to block 514.

At block 514, the feedback translator 306 may receive the filtered feedback values, translate the filtered feedback values using Tables 3 and 4 to determine correlated feedback values, and send correlated feedback values to the airflow control algorithm 300. For example, the feedback translator 306 may receive filtered control values of 950 RPM and 0.95 N-m and send correlated feedback values 999 RPM and 0.99 N-m to the airflow control algorithm 300. In other words, according to the correlated data of feedback translator 306, filtered feedback values of 950 RPM and 0.95 N-m are not accurate and the more accurate correlated feedback values of 999 RPM and 0.99 N-m may be sent to the airflow control algorithm 300 so that an error correction feature of the airflow control algorithm 300 may utilize data that is more representative of the actual fan motor 111 performance. After the feedback translator 306 has sent the correlated feedback values, the method 500 may progress to block 516.

At block 516, the airflow control algorithm 300 may receive the correlated feedback values for use in correcting any error between the correlated feedback values and the desired feedback value originally requested by the airflow control algorithm 300. For example, while the desired control value was either 1,000 RPM or 1N-m, the actual operation values were 980 RPM and 0.98 N-m but were ultimately represented to the airflow control algorithm 300 as the correlated feedback values of 990 RPM and 0.99 N-m. In some embodiments, the 10 RPM and 0.01N-m errors may be combated by the airflow control algorithm increasing the desired control value as a new desired control value of either 1,010 RPM or 1.01N-m which may increase the HVAC system 100 conformance to meeting the requested user input desired temperature of 70° F. Table 8 below provides a summary of the rotational speed and mechanical torque values used describing the method 500 above.

TABLE 8

| | Rotational Speed (RPM) | Mechanical Torque (N-m) |
|---|---|---|
| Desired Control Values | 1,000 | 1.00 |
| Correlated Control Values | 900 | 0.90 |
| Reported Feedback Values | 950 | 0.95 |
| Actual operation values | 980 | 0.98 |
| Correlated Feedback Values | 990 | 0.99 |
| New Desired Control Values | 1,010 | 1.01 |

Figure 6:
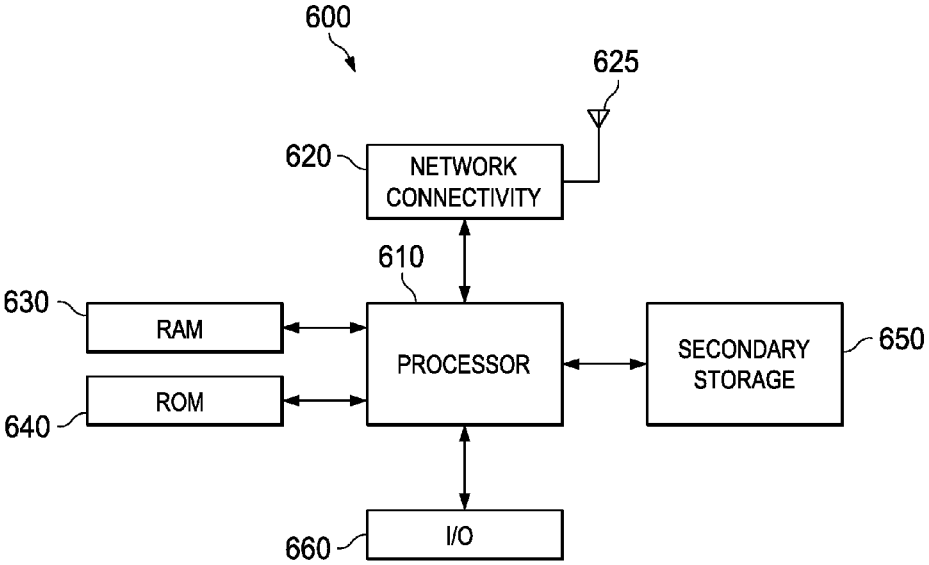
FIG. 6 is a representation of a general-purpose processor (e.g., electronic controller or computer) system suitable for implementing the embodiments of the disclosure.

FIG. 6 illustrates a typical, general-purpose processor (e.g., electronic controller or computer) system 600 that includes a processing component 610 suitable for implementing one or more embodiments disclosed herein. In addition to the processor 610 (which may be referred to as a central processor unit or CPU), the system 600 might include network connectivity devices 620, random access memory (RAM) 630, read only memory (ROM) 640, secondary storage 650, and input/output (I/O) devices 660. In some cases, some of these components may not be present or may be combined in various combinations with one another or with other components not shown. These components might be located in a single physical entity or in more than one physical entity. Any actions described herein as being taken by the processor 610 might be taken by the processor 610 alone or by the processor 610 in conjunction with one or more components shown or not shown in the drawing.

The processor 610 executes instructions, codes, computer programs, or scripts that it might access from the network connectivity devices 620, RAM 630, ROM 640, or secondary storage 650 (which might include various disk-based systems such as hard disk, floppy disk, optical disk, or other drive). While only one processor 610 is shown, multiple processors may be present. Thus, while instructions may be discussed as being executed by a processor, the instructions may be executed simultaneously, serially, or otherwise by one or multiple processors. The processor 610 may be implemented as one or more CPU chips.

The network connectivity devices 620 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices, and/or other well-known devices for connecting to networks. These network connectivity devices 620 may enable the processor 610 to communicate with the Internet or one or more telecommunications networks or other networks from which the processor 610 might receive information or to which the processor 610 might output information.

The network connectivity devices 620 might also include one or more transceiver components 625 capable of transmitting and/or receiving data wirelessly in the form of electromagnetic waves, such as radio frequency signals or microwave frequency signals. Alternatively, the data may propagate in or on the surface of electrical conductors, in coaxial cables, in waveguides, in optical media such as optical fiber, or in other media. The transceiver component 625 might include separate receiving and transmitting units or a single transceiver. Information transmitted or received by the transceiver 625 may include data that has been processed by the processor 610 or instructions that are to be executed by processor 610. Such information may be received from and outputted to a network in the form, for example, of a computer data baseband signal or signal embodied in a carrier wave. The data may be ordered according to different sequences as may be desirable for either processing or generating the data or transmitting or receiving the data. The baseband signal, the signal embedded in the carrier wave, or other types of signals currently used or hereafter developed may be referred to as the transmission medium and may be generated according to several methods well known to one skilled in the art.

The RAM 630 might be used to store volatile data and perhaps to store instructions that are executed by the processor 610. The ROM 640 is a non-volatile memory device that typically has a smaller memory capacity than the memory capacity of the secondary storage 650. ROM 640 might be used to store instructions and perhaps data that are read during execution of the instructions. Access to both RAM 630 and ROM 640 is typically faster than to secondary storage 650. The secondary storage 650 is typically comprised of one or more disk drives or tape drives and might be used for non-volatile storage of data or as an over-flow data storage device if RAM 630 is not large enough to hold all working data. Secondary storage 650 may be used to store programs or instructions that are loaded into RAM 630 when such programs are selected for execution or information is needed.

The I/O devices 660 may include liquid crystal displays (LCDs), touch screen displays, keyboards, keypads, switches, dials, mice, track balls, voice recognizers, card readers, paper tape readers, printers, video monitors, transducers, sensors, or other well-known input or output devices. Also, the transceiver 625 might be considered to be a component of the I/O devices 660 instead of or in addition to being a component of the network connectivity devices 620. Some or all of the I/O devices 660 may be substantially similar to various components disclosed herein.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and/or air conditioning (HVAC) system, comprising:

a motor configured to selectively provide an airflow;

an airflow control algorithm configured receive an input and to provide a desired control value associated with a desired actual operation value of the motor, wherein the desired actual operation value is provided as a function of the input;

a control translator configured to receive the desired control value and to provide a correlated control value to the motor, wherein the correlated control value is associated with causing the motor to operate at the desired control value; and a feedback translator configured to receive a reported feedback value reported by the motor, the reported feedback value being associated with an actual operation value of the motor, the feedback translator being further configured to send a correlated feedback value to the airflow control algorithm, wherein an absolute value of any difference between the correlated feedback value and the actual operation value is less than an absolute value of any difference between the reported feedback value and the actual operation value.

2. The HVAC system of claim 1, wherein the motor comprises a fan motor of an indoor unit of an HVAC system.

3. The HVAC system of claim 1, wherein the input comprises at least one of a desired temperature setting, a desired airflow rate, a desired relative humidity, a desired rotational speed of the motor, and a desired mechanical torque of the motor.

4. The HVAC system of claim 1, wherein the desired control value is not equal to the correlated control value.

5. The HVAC system of claim 1, the control translator comprising:

data correlating a set of correlated control values to a set of actual operation values of the motor.

6. The HVAC system of claim 5, wherein the data comprises data obtained from testing the motor using a dynamometer.

7. The HVAC system of claim 5, the control translator further comprising:

a control correlation table comprising the data.

8. The HVAC system of claim 1, further comprising:

a filter configured to receive the reported feedback value and to send a filtered feedback value to the feedback translator in place of the reported feedback value.

9. A method of operating a heating, ventilation, and/or air conditioning (HVAC) system, comprising:

operating an airflow control algorithm to provide a desired control value associated with a desired actual operation value of a motor of the HVAC system;

operating a control translator to receive the desired control value;

operating the control translator to provide a correlated control value to the motor;

operating the motor in response to the motor receiving the correlated control value;

providing a reported feedback value to a feedback translator;

operating the feedback translator to provide a correlated feedback value, wherein an absolute value of any difference between the correlated feedback value and the actual operation value is less than an absolute value of any difference between the reported feedback value and the actual operation value; and sending the correlated feedback value to the airflow control algorithm.

10. The method of claim 9, wherein the desired control value comprises a rotational speed value.

11. The method of claim 9, wherein the desired control value comprises a mechanical torque value.

12. The method of claim 9, wherein the correlated control value is part of a control correlation table.

13. The method of claim 12, wherein the control correlation table comprises data gathered by testing the motor using a dynamometer.

14. The method of claim 9, wherein the correlation between the correlated feedback value and the actual operation value was previously obtained as a result of testing the motor using a dynamometer.

15. A method of controlling a motor of a heating, ventilation, and/or cooling (HVAC) system, comprising:

providing an input to a universal airflow control algorithm that is configured to provide an output comprising a desired actual operation value of the motor;

operating the universal airflow control algorithm to send a desired control value to a control translator comprising a control correlation table, the control correlation table comprising correlation data obtained as a result of testing the motor with a dynamometer;

operating the motor in accordance with the desired control value;

receiving a reported feedback value from the motor to a feedback translator;

sending a correlated feedback value from the feedback translator to the universal airflow control algorithm, the correlated feedback value being more closely associated with an actual operational value of the motor than the reported feedback value;

generating a correlated control value by the universal airflow control algorithm in response to comparing the correlated feedback value to the desired control value; and operating the control translator to provide a correlated control value, the correlated control value being known as a relatively better input for providing to the motor as compared to the desired control value for the purpose of causing the motor to achieve the desired actual operation value.

16. The method of claim 15, wherein the correlation table comprises at least one of a rotational speed value and a mechanical torque value.

* * * * *